United States Patent [19]

Ganter et al.

[11] Patent Number: 4,947,179

[45] Date of Patent: Aug. 7, 1990

[54] ANTENNA FOR A RADIO CONTROLLED TIMEPIECE

[75] Inventors: Wolfgang Ganter, Schramberg; Arthur Kopf, Schramberg-Sulgen, both of Fed. Rep. of Germany

[73] Assignee: Junghans Uhren GmbH, Schramberg, Fed. Rep. of Germany

[21] Appl. No.: 353,026

[22] Filed: May 17, 1989

[30] Foreign Application Priority Data

May 27, 1988 [DE] Fed. Rep. of Germany ... 3817943[U]
Dec. 23, 1988 [DE] Fed. Rep. of Germany ..... 8815967

[51] Int. Cl.[5] ..... H01Q 1/12
[52] U.S. Cl. ..... 343/718; 455/351
[58] Field of Search ..... 343/718, 868; 455/351; 224/174, 175

[56] References Cited

U.S. PATENT DOCUMENTS 4,754,285 6/1988 Robitaille ..... 343/718
4,769,656 9/1988 Dickey ..... 343/718

FOREIGN PATENT DOCUMENTS 0100639 2/1984 European Pat. Off. ..... 343/718
0242717 4/1987 European Pat. Off. .
3516810 11/1986 Fed. Rep. of Germany .
58-53231 3/1983 Japan ..... 343/718

OTHER PUBLICATIONS

Article: Funkuhren, "Novel Radio Timepieces from the Data Technology Institute", Bermbach et al., pp. 169–170.

*Primary Examiner*—Rolf Hille
*Assistant Examiner*—Doris J. Johnson
*Attorney, Agent, or Firm*—Burns, Doane, Swecker & Mathis

[57] ABSTRACT

A magnetic antenna for a radio receiver such as a radio timepiece can be installed under restricted spacial conditions in a small housing or used as an antenna for a radio wristwatch. The antenna includes a core extending through a coil. The core is made of flexible, high permeability material, so that a flexible connection with the watch is obtained. A multiple flat strip conductor integrated into a watch bracelet serves as the connection between the coil and the receiver. Instead of being flexible, the core may be rigid but pre-formed in a non-linear shape.

24 Claims, 3 Drawing Sheets

ANTENNA FOR A RADIO CONTROLLED TIMEPIECE

BACKGROUND OF THE INVENTION

The invention concerns an antenna for portable devices such as the radio receiver of a radio timepiece, as described in detail in European Pat. No. 0 242 717.

In the case of small timepieces, such as, for example, small fashion watches or travel alarm clocks, it is difficult to locate a long-wave antenna of adequate capacity to receive the time information transmitted by radio, in the small, angled space available between the clock movement and the inner wall of the case or hinged structural parts.

The development of a radio timepiece in the form of a wristwatch has heretofore been considered not feasible, firstly, because of the insufficient space required for the placement of the radio receive (see R. Bermbach and M. Lobjinski, "Novel Radio Timepieces From the Data Technology Institute" in FUNKUHREN, edited by W. Hilberg, center page 170), wherein the problems of the location of an adequate magnetic core frame antenna volume is not even considered. The problem of the space requirements of the receiver has been solved in the meantime, because now fixedly tuned long-wave receivers integrated on a chip are available for radio timepieces, see for example, German Pat. No. 35 16 810. However, there remains the problem of miniaturizing adequately powerful passive antennas for long-wave receivers, which, for example in the case of modern consumer timepieces, are to be operated with a single cell battery.

In view of the above, it is an object of the invention to develop an antenna which may be installed even under narrow and angled spacial conditions and can be used as a high capacity long-wave antenna for portable devices, such as a radio wristwatch.

SUMMARY OF THE INVENTION

This object is achieved in accordance with the present invention by means of an antenna comprising a flexible core disposed within a coil. The core and the coil are embedded within a flexible enclosure, whereby the antenna can be bent to different configurations.

This invention is based at least partly on the recognition that a principal obstacle to creating a frame antenna suitable for narrow spacial conditions lies not so much in the volume of the ferrite core passing through the frame coil, but rather in the space required for a rigid cylindrical core or the grouping of several cores arranged in a defined mutual geometric orientation. For this reason, the invention contemplates a flexible core for a frame antenna, such as may be realized using several mutually displaceable flexible strips of soft ferrite cores of soft magnetic materials of high permeability, which may be obtained, in particular, with amorphous metals in sheet of powder form. Such an antenna may be angled, depending on the existing installation possibilities, for example in L, U or Z shapes, in order to optimally utilize the available space for the build-in antenna, while simultaneously providing different spacial receiver orientations. But such a flexible core stack of individual magnetically effective strips may also be designed, such as bent into an annular segment, as part of a watch bracelet, representing the antenna for a receiver carried, for example, under clothing or directly on the wrist and thus may serve for example directly as the bracelet antenna of a radio wristwatch, or be set into such a watch bracelet.

The capacity for an oscillatory circuit tuning of the antenna may be integrated into the layer structure, for example by interconnecting individual layers (electrically insulated to avoid eddy current losses) as alternating electrode groups into a capacitor and connecting them parallel to the antenna coil.

For the electrical connection of the coil for such a flexible frame antenna there can be used a structure of a multiple layer conducting foil laminated to insulating sheets, in the center of which a relatively narrow conductor is located. The conductor is electrically shielded by broader conducting foils extending under and above it, which may serve simultaneously as the return conductor of the antenna connection to the radio watch receiver.

Such an electrically tunable flat strip conductor is conveniently adhesively bonded before the antenna to the core. At the place where the conductor is connected to the coil connecting wires a miniature smoothing capacitor for the antenna resonance circuit may be provided. The opposing end of the flat strip conductor is equipped with a plug-in connector, oriented preferably approximately in a direction transverse to the longitudinal extent of the conductor and thus transverse to the tension direction of the flat strip conductor entering the watch case. That connector plugs into a complementary receptor in the watch case.

A soft elastic molded sheathing of the antenna core and coil conveniently extends to the plug means located in the watch case, so that a clamp fastener of the bracelet casing at the inlet into the watch case also serves to mechanically fasten the sheathing and provide a seal against humidity. However, a flat strip connection may, for example, also be installed between a folding alarm clock stand equipped with an antenna and a swiveling clock movement, into which the receiver is installed.

It is also possible in accordance with the invention for the core to be rigid, but pre-formed into a non-linear shape necessary for insertion into the space where the antenna is to be received.

BRIEF DESCRIPTION OF THE DRAWING

The objects and advantages of the invention will become apparent from the following detailed description of preferred embodiments thereof in connection with the accompanying drawings in which like numerals designate like elements, and in which.

DETAILED DESCRIPTION OF PREFERRED EMBODIMENTS OF THE INVENTION

Figure 1:
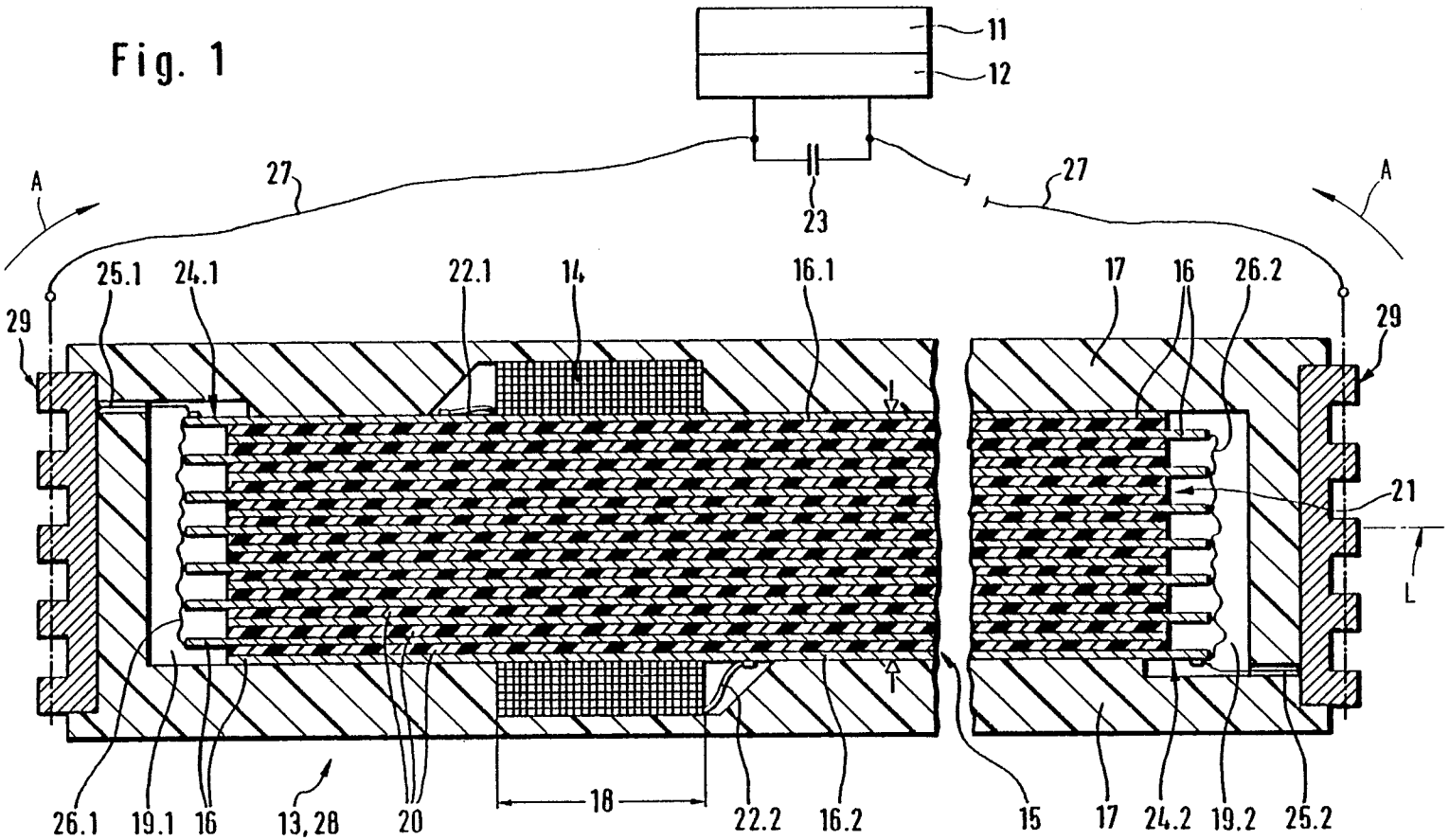
FIG. 1 is a fragmentary longitudinal sectional view through a flexible magnetic antenna in the form of a radio watch bracelet.

A radio watch 11, indicated schematically in FIG. 1, includes a radio receiver 12 for the reception and decoding of time information, potentially serving to correct the time instantaneously displayed by the radio watch 11. The receiver 12 is powered by an antenna 13 in the form of an L-C oscillator circuit. The antenna is designed as a layer core frame antenna, i.e., a coil penetrated by a flexible core 15.

The core 15 comprises a stack of very thin strips 16 of an amorphous soft magnetic, high permeability material, such as marketed, for example, under the commercial designation VITROVAC by the Vacuumschmelze GmbH Co. (D-6450 Hanau). The strips are extremely thin, springy, and flexible, and are specifically useful for the construction of low loss transmitters in circuit network components and for magnetic switches of pulsed power sources. The material of the strips is characterized by a low sensitivity relative to mechanical stresses.

Figure 5:
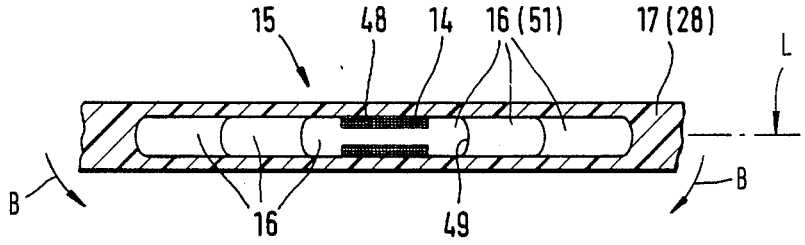
FIG. 5 is a longitudinal sectional view through a bracelet depicting a cavity therein which contains n alternative core structure which facilitates transverse bending.
Figure 6:
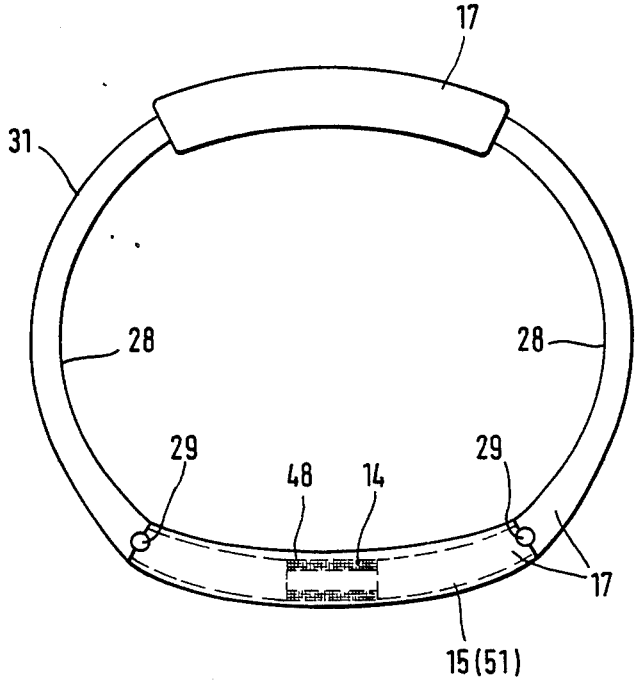
FIG. 6 depicts a bracelet with a relatively rigid core connected between flexible parts of the bracelet.

The core 15 is clamped in a direction transversely to the planes of the strips 16 by an enclosure 17, as shown by arrows in the drawing. The enclosure 17, for example in the form of a plastic coating which is injection molded around the core 15, conveniently also covers the coil 14 in order to fasten it as a layer to the core 15 and to physically protect the coil and core against ambient conditions. If the enclosure 17 is flexible in order to make possible different geometrical configurations of the antenna 13 (for example for installation in restricted spaces or for a design as a bracelet), the axial length 18 of the coil 14 will be made relatively short, in order to keep the area of the interface between the non-flexible core 15, and the coil 14 as small as possible. On the other hand, a coil 14 extending radially as short as possible from the core 15 is desirable for electromagnetic reasons, as the field strength decreases dramatically with the distance from the core 15, i.e., the remote winding layers of the coil 14 receive very slight field strengthening effects from the core 15. Appropriately, the coil 14 may be placed into a recess 48 of the core, as shown in FIGS. 5 and 6.

Again in the interest of the flexibility of a stacked core 15, free spaces 19.1, 19.2 are provided adjacent both ends of the strips 16, opposite inner portions of the enclosure 17. This makes possible the longitudinal displacement of individual strips 16 relative to each other, when the ends of the core 15 are bent in directions A shown in FIG. 1 which are transverse to the longitudinal direction L.

If, instead of this, or in addition to it, it is desired that the antenna bracelet be flexible in another direction B transversely to the longitudinal extent of the strip 16 (FIG. 5), the strips are provided with convex, rounded ends 49 inserted into concavely shaped recesses or swivel cups of the adjacent strip 16. This arrangement facilitates bending of the strips in direction B. The strips may be arranged coplanar wherein only the center strip passes through the coil, or the strips may be arranged in a stack as in FIG. 1. The strips 16 (or those located outside) may also be replaced by a filling 51 of a soft ferrite powder in the associated part of the enclosure 17 in the bracelet 28.

If flexibility of the core is not highly important, the individual articulated strips 16 may comprise a rigid piece of (sintered) ferrite, which is pre-formed into a non-linear (preferably curved) shape suitable for insertion into the receptor space.

If a relatively rigid core 15, for example in the form of a one-layer or multiple-layer ferrite body, is provided, it may be appropriate for aesthetic reasons to design it in its enclosure 17 geometrically as an optical counter piece to the watch 11 itself (FIG. 6) and in an anatomical adaptation to the arm, in the form of a pre-curved annular segment. The connection with the watch 11 is effected by means of two bracelet segments 28, which may be connected through closures or articulated elements 29 with the antenna core 15.

In order to retard the abrasion phenomena as much as possible during the mutual parallel displacement of the strips 16 of a flexible core 15 and to simultaneously reduce eddy current losses in the ferrite core 15, the individual strips 16 are mechanically separated and electrically insulated by insulating layers 20, which may for example comprise foil or layers of lacquer.

For this insulation 20, appropriately a flexible material with a high dielectric constant is used, such as for example the commercially available so-called X7R ceramic for the build-up of small, high capacity layer capacitors. If the core 15 is to be bent to a small radius, conventional dielectrics, such as mica or polyester or polycarbonate films, or the like, are more advantageous.

This insulating material may be covered or layered with electrically conducting electrodes, in order to simultaneously integrate a tuning capacitor 21 into the stacked strip antenna 13 and to connect it within the protective enclosure 17, for example by welded joints 22, with the ends of the coil 14. This reduces the capacity values and thus the space required by an external tuning capacitor 23, if the latter cannot be eliminated entirely by the internal capacitor 21.

The electrically conducting core strips 16 themselves may serve on both sides of the dielectric insulating film 20 as the capacitor electrodes, so that the separate insertion of capacitor electrodes on both sides of the insulation 20 may be eliminated. As known from the technology of film capacitors, these electrode strips 16 are interconnected alternatingly in order to obtain a large electrode surface and thus a high capacity value, in a manner such that comb-like electrode groups 24.1 and 24.2 are produced. Of these, the outermost strip 16.1 and 16.2 may serve as the conductors to connect the coil terminals 22.1 and 22.2 with the outward leading antenna junctions 25.1 and 25.2. But the flexible circuitry 26.1, 26.2 between the electrode strips 16 of the electrode groups 24 in the area of the associated free spaces 19.1, 19.2 the alternating, axially parallel displaceability of the strips 16 relative to each other in case of any bending stressing of the ferrite core 15 remains assured.

The antenna 13 comprising the coil 14 and the core 15 and optionally the resonance capacity 21, may be electrically connected by means of the lines 27 with the radio receiver 12 of the watch 11, in whose case the antenna 13 is inserted. If a portable radio timepiece 11 and in particular a wristwatch layout is involved, the flexible antenna is conveniently made integral with a bracelet 28 by means of the articulated elements 29.

The latter 20 may be electrically connected directly, or if necessary by means of extension elements, with the electric terminals of the case of a wristwatch, if such terminals are insulated electrically from each other, so that additional connecting lines 27 may be eliminated. However, it is sufficient to configure one-half of a bracelet, or an intermediate piece of a bracelet 28, as the antenna 13. To be able to replace defective bracelets 28 easily and inexpensively, the antenna 13 may also be provided in the form of sleeve-like flexible hollow bodies, through which the replacement bracelet 28 is threaded, without having to replace the antenna 13 and to retune the receiver 12 or its oscillating antenna circuit.

In this manner, a radio-controlled timepiece such as a wristwatch 11 may be realized, in which the dimensions or configurations relative to the space requirements of a receiving antenna 13 need no longer be of special concern. A layered antenna 13 of this type in the form of a bracelet 28 has an astonishingly high capacity, compared with conventional cylindrical ferrite cores as coil carriers, as the antenna voltage is proportional to the core cross-section and primarily to the permeability of the core material (which is here very high), and approximately proportional to the core length and approximately inversely proportional to the thickness of the core. The core 15 carrying the coil 14 may have a small thickness in view of its high permeability and may be long axially in the interest of the high flexibility of the bracelet 28, relative to the magnetically effective thickness of the stacked core strips 16 as such.

However, under certain conditions, the electrical connection of the antenna 13 with the receiver 12 outlined in FIG. 1 by means of articulated bracelet elements 29 to the watch case, may not be sufficiently reliable, for example in view of the entry of dirt between the articulated elements. Furthermore, free lines 27 may be aesthetically or electrically objectionable, the more so since they must be equipped with plug connectors for their connection with the watch case, which must be made watertight at considerable structural expense.

A further factor to be considered involves the need to shield these antenna connection line 27 between the receiver 12 and the magnetic antenna 13 in order to avoid interference by scatter current.

It is, therefore, more appropriate to accomplish the electrical function of the lines 27 or the articulated contact elements 29 by means of an alternative structure comprising a multilayer flat strip conductor 31 electrically tuned to the oscillator circuit of the antenna, for example in the manner of the laminated multilayer films marketed by the DuPont Co. under the commercial designation of PYRALUX. The conductor 31 comprises at least one narrow conductor 32 sandwiched between two plastic insulating films 33 which are, in turn, sandwiched between two outer, broad conducting films 33 in an electrically insulated manner. These conductor films 33 project laterally beyond the width of the narrow centered conductor, so that the outer conducting films 33 shield the conductor 32. The narrow conductor 32 and the conducting films 33 are conveniently in the form of metallic laminations formed on the insulating plastic supporting films 34. The upper conductor film 33' and the upper plastic film 34' are not shown in FIG. 3, whereby the lower plastic film 34'' is visible, along with a portion of the lower conductor film 33'' which is visible through an opening in the film 34''.

In the interest of facilitating the production of durable connections, the entire layer structure of the flat strip conductor 31 is fastened by means of an insulating adhesive layer 36 to a surface of the flexible strip core 15 at a location adjacent a front edge 35 of the coil. At the connecting end 37 (FIG. 3) of the flat strip conductor 31, recesses R are provided in the upper shielding conducting film 33' (not shown in FIG. 3) and in the insulating film 34'' above the lower conducting film 33'', in order to be able to connect the coil connecting lines 22 with the center conductor 32 and the lower shielding film 33'' (the latter serving as the return conductor). If a shielding capacitor 23 is required for antenna tuning, it is located conveniently also in this connecting area between the flat strip conductor 31 and the antenna coil 14, for example in the form of a surface mounted chip capacitor connected between the conductor 32 and the conducting film 33''. The enclosure 17 is then injection molded to surround this connection.

Figure 2:
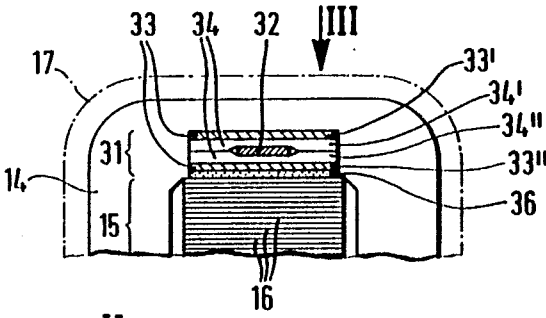
FIG. 2 is a cross-sectional view through a bracelet antenna of the type shown in FIG. 1, including showing a flat strip conductor resting on the core in front of the coil, the cross-sectional view is taken along line II—II in FIG. 3.
Figure 3:
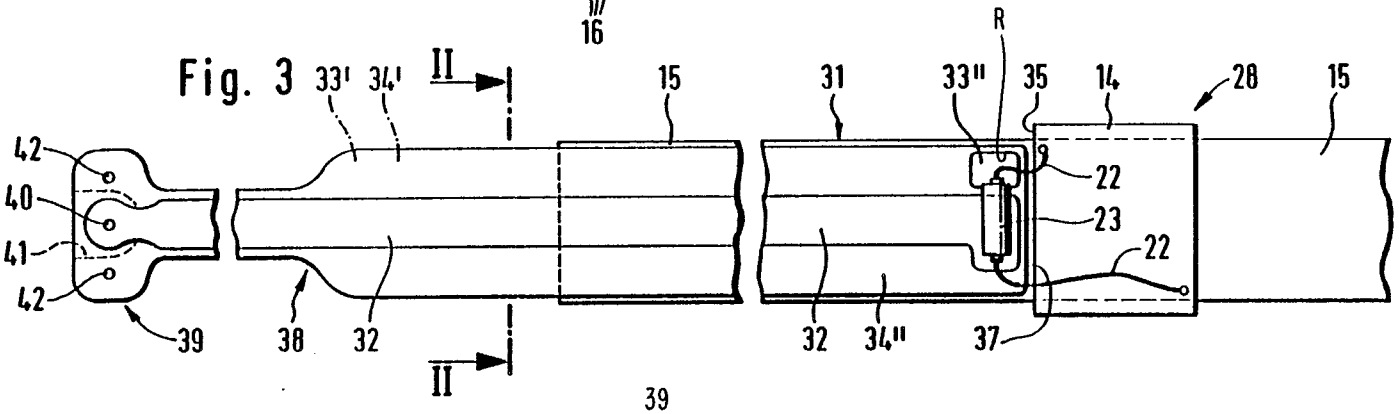
FIG. 3 is a plan view of the flat strip conductor according to FIG. 2 with the cast molding and the upper shielding conducting foil removed, together with the insulating foil located under it, and without consideration of the tuning capacitor mounted in the coil connection area.
Figure 4:
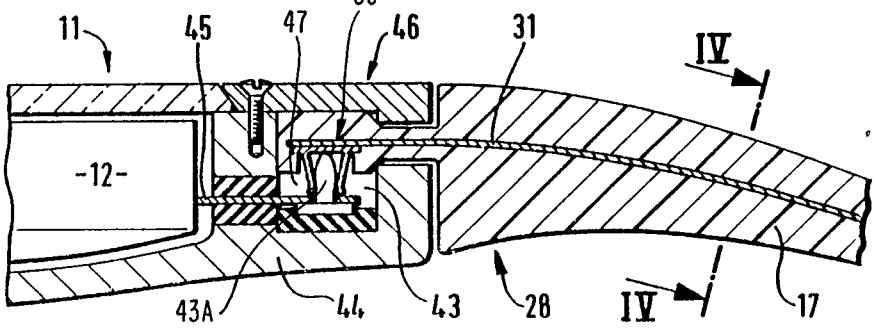
FIG. 4 is a longitudinal sectional view of a clamp fastening of the bracelet to the edge of a watch case, with plug-in means oriented transversely to the direction of tensile stress for the electrical connection of the watch movement receiver to the flat strip conductor of the antenna.

In front of the core end 37, the flat strip conductor 31, as shown in FIG. 3, may comprise a constant width in the interest of a high bending strength, and then narrow into a softer bending zone 38 of the conductor. This terminates finally in a widened connecting area 39 with a conducting lug 39 in the area of a conducting film recess 41 and a pair of lugs 42 through the films 33 on both sides of the recess 41. Plug-in means (e.g., plug pins 43) are set into the lugs 40, 42, in order to be connected (FIG. 2) to corresponding plug-in means (e.g., pins 43A) in a plug-in direction transverse to the longitudinal extent of the flay strip conductor 31. Thus, the conductor 31 is mechanically and electrically coupled at the edge of a wristwatch case 44, and to connectors 45 which are coupled to the radio watch receiver 12 mounted there in an insulated manner.

A clamping case joint 46 is provided to create a vapor tight seal and to be coupled with the elastic molded enclosure 17 which terminates in the connecting area 39 of the flat strip line 31 in a joining cavity 47. Here, case mounted counter contacts to the plug means 43 in the flat strip lugs 40, 42 are located in an insulated manner. This results in a vapor tight, mechanically strong and electrically high performing antenna connection to the receiver 12, for example in the case of a wristwatch 44.

A convenient additional expedient, not specifically shown in the drawing, is provided to compensate for the variations of inductivity due to the relative permeability of the core material under mechanical (bending) stress to retune the variable circuit frequency. For this end, in the receiver 12, a compensating control may act on the oscillating circuit frequency, for example, an actuable capacitor cascade or by means of a corresponding actuation of a capacitor diode.

Although the present invention has been described in connection with preferred embodiments thereof, it will be appreciated by those skilled in the art that additions, modifications, substitutions, and deletions not specifically described may be made without departing from the spirit and scope of the invention as defined in the appended claims.

What is claimed is:

1. An antenna for a small radio timepiece comprising a flexible core disposed within a coil, said core and coil embedded within a flexible enclosure, whereby the antenna can be bent into different configurations in a direction transversely of a longitudinal axis of the antenna.

2. Antenna according to claim 1, wherein said enclosure comprises at least a portion of a bracelet adapted to be worn around a user's wrist.

3. Antenna according to claim 1 including two bracelet segments attached to the ends of a said enclosure.

4. Antenna according to claim 3, wherein said enclosure includes electric plug-in connectors at its opposite ends for attachment to electric conductors in said bracelet segments.

5. Antenna according to claim 1, wherein said core comprises a soft ferrite powder encased in said enclosure.

6. Antenna according to claim 1, wherein said core comprises a stack of thin strips formed of a highly permeable amorphous metal.

7. Antenna according to claim 6, wherein a space is provided between said enclosure and opposite ends of said strips to accommodate relative longitudinal displacement of said strips.

8. Antenna according to claim 1, wherein said core comprises a plurality of thin flexible strips formed of a highly permeable amorphous metal, the ends of at least some of said strips being seated in curved recesses formed in adjacently disposed ones of said strips to facilitate bending of said core.

9. Antenna according to claim 6 including insulation strips disposed between adjacent ones of said metal strips.

10. Antenna according to claim 9, wherein said metal strips define electrodes of a resonance capacitor.

11. Antenna according to claim 9, wherein said metal strips define a tuning capacitor.

12. Antenna according to claim 1 including a tuning capacitor for compensating for circuit frequency variation due to mechanically induced permeability variation of the core, said capacitor being carried by a portion of said core.

13. Antenna according to claim 1 including a watch case containing a radio receiver, a bracelet connected to said watch case, a multilayer flat conductor mounted to said bracelet, said conductor being electrically connected to said radio receiver.

14. Antenna according to claim 13, wherein one end of said conductor is fastened to the core adjacent the coil, and another end having electrical plug-in means.

15. Antenna according to claim 13, wherein said conductor is disposed in said enclosure, an end of said enclosure being clamped to said case in a direction transversely to a longitudinal direction of said conductor.

16. Antenna according to claim 13, wherein said conductor comprises a conducting line sandwiched between and insulated from two conducting films.

17. An antenna for a small radio timepiece comprising a rigid core pre-formed in a non-linear shape and disposed within a coil, said core and coil embedded within an enclosure.

18. Antenna according to claim 17, wherein said enclosure comprises at least a portion of a bracelet adapted to be worn about a user's wrist.

19. Antenna according to claim 17 including two bracelet segments attached to opposite ends of said enclosure.

20. Antenna according to claim 19, wherein said enclosure includes electric plug-in connectors at its opposite ends for attachment to electric conductors in said bracelet segments.

21. Antenna according to claim 17 including a watch case containing a radio receiver, a bracelet connected to said watch case, a multilayer flat conductor mounted to said bracelet, said conductor being electrically connected to said coil and said radio receiver.

22. Antenna according to claim 21, wherein one end of said conductor is fastened to the core adjacent the coil, and another end having electrical plug-in means connected to said radio receiver.

23. Antenna according to claim 21, wherein said conductor is disposed in said enclosure, an end of said enclosure being clamped to said case in a direction transversely to a longitudinal direction of said conductor.

24. Antenna according to claim 21, wherein said conductor comprises a conducting line sandwiched between and insulated from two conducting films.

* * * * *